United States Patent [19]

Glesser

[11] 4,231,194

[45] Nov. 4, 1980

[54] BLADE SHARPENER

[76] Inventor: Louis S. Glesser, P.O. Box. 800, Golden, Colo. 80401

[21] Appl. No.: 62

[22] Filed: Jan. 2, 1979

[51] Int. Cl.[3] ..... B24B 3/54

[52] U.S. Cl. ..... 51/211 R

[58] Field of Search ..... 51/211 R, 211 H, 212, 51/214; 76/82.2, 86

[56] References Cited

U.S. PATENT DOCUMENTS

| | | | |
|---|---|---|---|
| 690,172 | 12/1901 | Montgomery | 51/214 |
| 1,223,127 | 4/1917 | Walker | 51/211 R |
| 2,674,072 | 4/1954 | Lohmann | 51/211 R |
| 3,280,514 | 10/1966 | Raymond | 51/211 R |
| 3,894,362 | 7/1975 | Graves | 51/211 R |

*Primary Examiner*—Gary L. Smith

*Attorney, Agent, or Firm*—Roger A. Marrs

[57] ABSTRACT

A device for sharpening cutting edges such as straight or serrated blades is disclosed herein having an elongated base provided with star-shaped openings intended to insertably receive triangular sharpening elements so that a selected side of the triangular element is exposed against which one side of the blade to be sharpened may be drawn. Each of the triangular elements includes an elongated element composed of a suitable porcelain material which includes at least three substantially flat surfaces which are joined together by a small radius. Each of the star-shaped openings are angularly disposed with respect to the horizontal at a predetermined angle so as to orient the sharpening element to a desired degree with respect to the edge to be sharpened when the edge is held in a vertical plane.

6 Claims, 7 Drawing Figures

FIG. 1
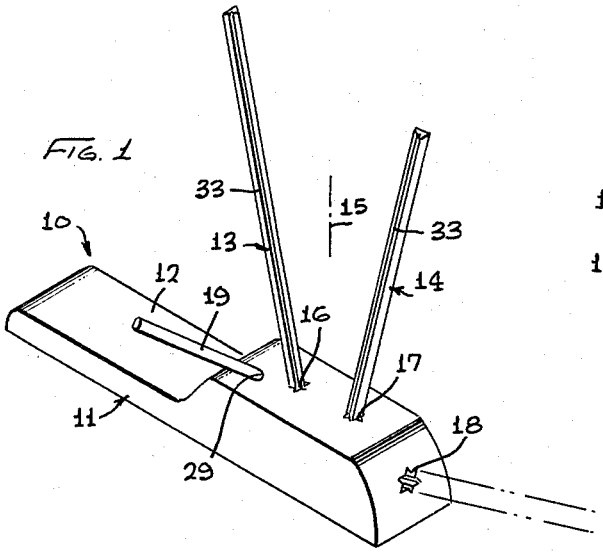
FIG. 3
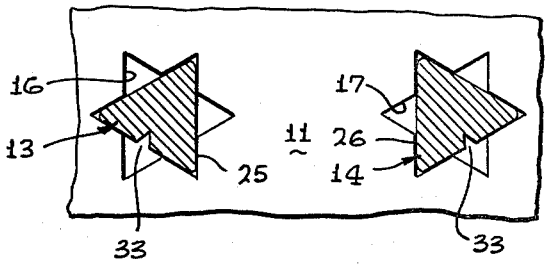
FIG. 4
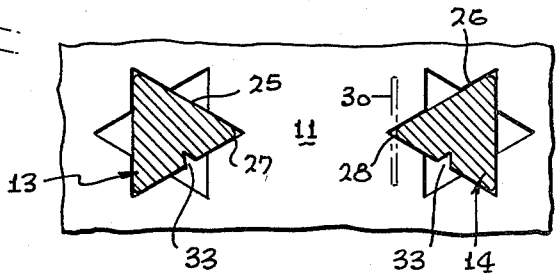
FIG. 5
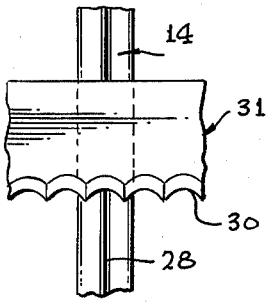
FIG. 6
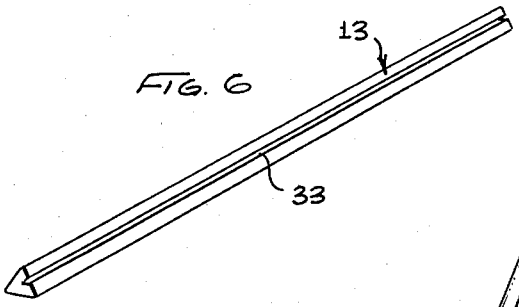
FIG. 7
FIG. 2
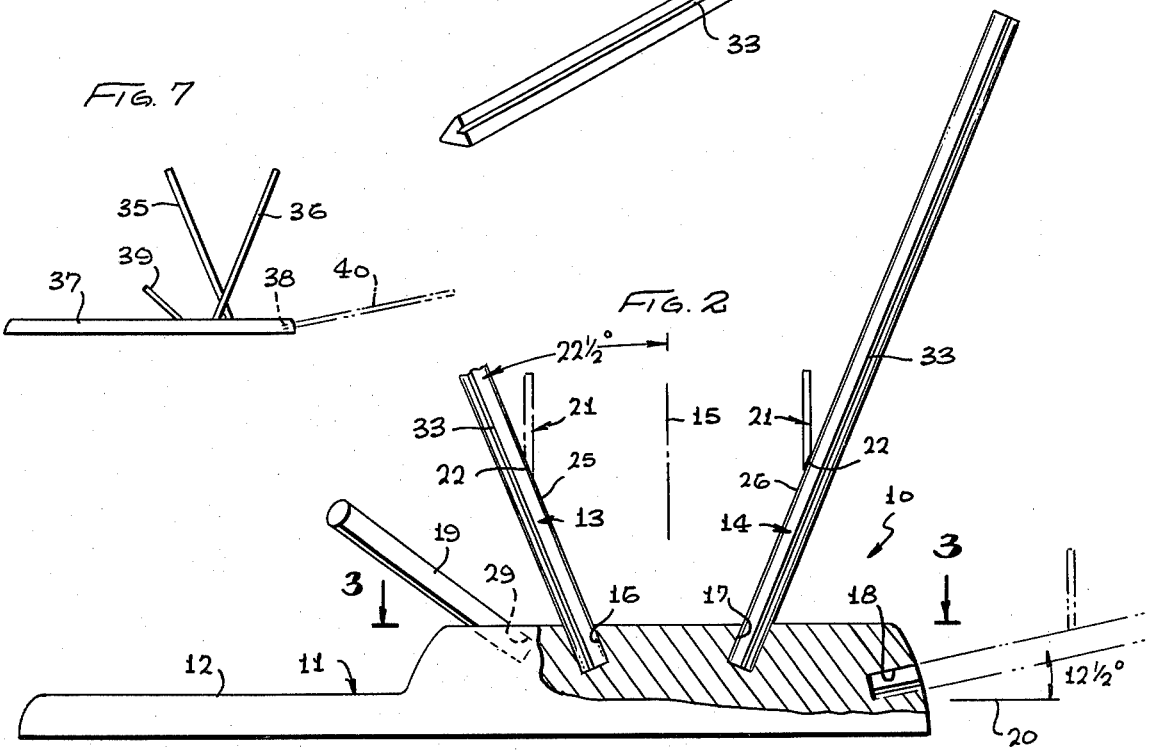

BLADE SHARPENER

BACKGROUND OF THE INVENTION

1. Field of the Invention

This invention relates to blade sharpeners of the straight or serrated blade type and more particularly to a novel blade sharpener which will effectively sharpen the edge of knives, scissors or the like and which will not carry into the blade to be sharpened, any impurities or abrasion marks carried on the sharpening element.

2. Brief Description of the Prior Art

In the past, it has been the conventional practice the sharpen blades by drawing the cutting edge of the blade over an abrasive material. One such prior device is shown and disclosed in U.S. Pat. No. 3,894,362. Although this device is useful in the sharpening of serrated blades in particular, difficulties have been encountered when attempting to use the device for sharpening a straight edge or when attempting to sharpen the blades associated with scissors. These problems and difficulties stem largely from the fact that the sharpening elements in the aforementioned patent provide a rounded surface to the blade and this has a tendency to draw metal from the blade so that it will clog or load up the pores of the abrasive material on the sharpening element. It is clear from a reading of the prior patent that the element is a rod and is intended to include a circular surface as a sharpening medium. Such a cylindrical rod may work well with serrated edges as shown in FIG. 3 of the prior patent; however, a straight edge blade does not sharpen well on a cylindrical surface. In order for the prior device to be used, it is necessary that the person sharpening the blade constantly rotates or turns the cylindrical rod in its receiving hole so as to offer a clean surface to the blade during the sharpening procedure. Such a procedure is awkward and cumbersome which requires added steps that are normally to be avoided since the sharpening of a knife is a dangerous procedure.

Therefore, a long standing need has existed to provide a novel knife sharpener which will also sharpen the edges of scissors, chisels and other cutting implements and which will avoid the problem of premature clogging or loading due to the gathering of removed material from the cutting edge as it is sharpened.

SUMMARY OF THE INVENTION

Accordingly, the above problems and difficulties are obviated by the present invention which provides a novel blade sharpener comprising an elongated base having a plurality of star-shaped openings formed therein and disposed in fixed spaced relationship with one another at given and predetermined angles with respect to a horizontal plane. Sharpening elements which are composed of an abrasive material and which are triangular in cross section are insertibly received within selected ones of the star-shaped openings in a selected orientation so as to be effective for sharpening straight edge blades or serrated blades. Each of the flat surfaces of the triangular sharpening element join adjacent flat surfaces by a radius so as to be available for sharpening a serrated blade when desired.

Each of the abrasive sharpening elements includes an elongated shaped groove serving as a fish hook sharpener whereby insertion of the abrasive sharpening element into a selected star-shaped opening exposes the groove to the user for sharpening of a fish hook.

Therefore, it is among the primary objects of the present invention to provide a novel blade sharpening device which is capable of sharpening straight edge blades, serrated blades, scissors, chisels or the like.

Another object of the present invention is to provide a novel blade sharpener which avoids the clogging of the abrasive pores in the sharpening element with removed metal from the edge being sharpened.

Still another object of the present invention is to provide a novel blade sharpener which employs flat faced abrasive sharpening members or elements whereby the blade to be sharpened may be drawn on the flat surface thereof without the blade encountering long marks or other distortions derived from impurities in the abrasive surface.

Still a further object of the present invention is to provide a novel blade sharpener which provides an angle of cut which is burr free and which is not injurious to the person practicing the sharpening procedure.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is a perspective view of the novel blade sharpener of the present invention showing the abrasive sharpening element in position for sharpening a blade;

FIG. 2 is a side elevational view, partly in section, illustrating the angular displacement of the sharpening element with respect to a perpendicular plane;

FIG. 3 is an enlarged sectional view of the base member used in the blade sharpener of FIG. 2 as taken in the direction of arrow 3—3 thereof;

FIG. 4 is a view similar to the view of FIG. 3 showing insertion of the blade sharpening elements in a different orientation from the orientation shown in FIG. 3;

FIG. 5 is an enlarged fragmentary and elevational view of the sharpening element and one of the blades of a serrated blade;

FIG. 6 is a perspective view of a sharpening element used in the sharpener of FIGS. 1 and 2; and FIG. 7 is a front elevational view of a modified form of the blade sharpener incorporating the present invention so that the invention may sharpen straight blades, serrated blades and scissors.

DESCRIPTION OF PREFERRED EMBODIMENT

Referring to FIG. 1, the novel blade sharpener of the present invention is illustrated in the general direction of arrow 10 which includes an elongated base 11 having a handle portion 12 intended to be pressed against a supporting surface by the users hand. The device further includes a pair of abrasive sharpening members 13 and 14 which are angularly disposed with respect to a vertical plane indicated by the numeral 15. Each of the sharpening elements are insertably received and supported within a star-shaped hole or opening indicated respectively by numerals 16 and 17 associated with elements 13 and 14 respectively. An alternate star-shaped opening is indicated by numeral 18 and may insertably receive one of the rods 13 and 14 when it is desired to sharpen scissors. Preferably, the orientation of the elements 13 and 14 when supported from openings 16 and 17 are useful in the sharpening of straight or serrated knife blades. However, the angle of the opening 18 is such that the sharpening element supported therefrom is at an angle useful for sharpening the blades of scissors.

Referring now to FIG. 2, it can be seen that the openings 16 and 17 are rather deeply formed in the body of the base 11 and that the openings are arranged in spatial relationship with respect to each other so that they are angularly disposed in a divergent manner. It can be seen that when the openings 16 and 17 are supporting sharpening elements 13 and 14, the divergent relationship is carried into the rod so that a substantial V in elevational view is produced. With respect to a vertical plane 15, the abrasive sharpening elements 13 and 14 are arranged at a 22½° angle which is the proper angle for sharpening of straight and serrated blades. The opening 18 is arranged at a 12½° anglular relationship with respect to a horizontal plane indicated by numeral 20 which represents the proper angular relationship when the sharpening of a scissor cutting edge is involved.

In use, a knife such as that shown by the numeral 21 and having a cutting edge or blade 22 is situated so that its blade is in perpendicular relationship to the longitudinal axis of the base 11 and so that its cutting edge is initially in contact with an upper portion or elevation of one of the abrasive sharpening elements. Maintaining this perpendicular relationship with respect to the base, the blade is "cut" down into the sharpening element and the knife is moved longitudinally at the same time so that the point of contact moves down the element 13 and from adjacent the blade to adjacent the tip of the knife. This action is repeated on the other side of the knife blade being initially put into contact with the left side of the sharpening element 14 and the longitudinal movement of the knife blade again accompanies the downward cutting action of the blade against the element 14. This action is repeated on the left and right side of the knife blade until the blade is sharpened. The procedure is successful for sharpening both serrated and straight edge cutting blades.

Referring now in detail to FIG. 3, it can be seen that the opening 16 and 17 are star-shaped having the representation of a six pointed star. It has also been set forth earlier in this description that each of the sharpening elements are of triangular cross section and that the elements are supported in the openings 16 and 17 by the base 11. Since the cross section or triangular design of the sharpening element is half of a six pointed star, a variety of orientations may be obtained when placing the element within a respective star-shaped opening. When it is desired to sharpen a straight bladed knife, the sharpening elements are oriented as shown in FIG. 3 so that a selected flat surface of the triangular design oppose one another with respect to each of the sharpening elements 13 and 14. For example, flat surface 25 associated with element 13 is opposite to and opposing flat surface 26 associated with sharpening element 14. By this means, any impurities or imperfections in the abrasive surfaces 25 and 26 will not be carried over into a long scored line in the blade or cutting edge as the blade is drawn across the flat surface. This is a major distinction over the prior art wherein cylindrical rods are employed since a single imperfection in the rod will cause a score line to occur in the blade or cutting edge by the prior art procedure. Also, when metal is removed from the blade as it is drawn over the flat surface 25 and 26, the metal will deposit over a greater area than that of the small radius associated with cylindrical rods as employed in the prior art device.

Referring to FIG. 4, it can be seen that when the abrasive elements 13 and 14 are arranged within the star-shaped openings so that radiuses 27 and 28 are opposite to one another, the radiuses may be employed for sharpening a serrated blade as shown in FIG. 5. The serrations of the blade are indicated by numeral 30 and the blade is indicated by numeral 31. This latter figure clearly shows the relationship of the knife blade to the sharpening radius of the sharpening element. From this figure, it is evident that the actual sharpening takes place at a point of contact between the knife blade and the sharpening element. Again, since the abrasive elements 13 and 14 are arranged at an angular relationship, each of the blade segments of the serrations will be sharpened in an identical fashion or manner.

Referring now in detail to FIG. 6, a perspective view of the abrasive sharpening element, for example, element 13, is illustrated. A selected one of its three flat faces is provided with a V shaped groove 33 which may be used for the sharpening of a conventional fishing hook. The rod is placed in a selected opening 16 or 17 and the hook is placed within the groove and drawn from one end of the groove to the other. Metal is removed from the edge of the hook to effect sharpening. The employment of a groove 33 in a selected flat face does not substantially or adversely affect the flat surface for performing its function in sharpening a flat blade. Sufficient area is offered to a straight blade so that it may be sharpened in the manner previously described.

Referring now to FIG. 7, an alternate version of the present invention is illustrated wherein cylindrical rods 35 and 36 are employed in a similar fashion to the invention disclosed in the prior patent. However, the base 37 is provided with an opening 38 intended to receive a cylindrical rod 40 to be used for sharpening scissors. The end rod is 12½° in angular deposition from the horizontal plane supporting the base 37. Angular desposition of rod 40 is not a matter of choice in this present instance since the angle may be gained on any of the cylindrical rods by manually moving a rod to a desired angular disposition. However, it is the concept of the present invention that the scissor blade may be held in a vertical plane and that the rod held at a 12½° disposition with the base 37 positively supported on a supporting surface. If the users hand is permitted to orient the rod to the particular or desired angular disposition, then the scissors cannot be held at a vertical disposition which not only increases the difficulty in manually sharpening the scissor cutting edge but adversely affects the sharpening of that edge.

Another feature of the present invention is the inclusion of a guard means for protecting the hand of the user. In FIGS. 1 and 2, a rod or element 19 is inserted into a hole 29 in the base 11 adjacent the element 13 so as to be between the handle 12 and the cutting or sharpening action of the knife blade on element 13. Rod 19 is angularly disposed with respect abrasive element 13 so that it projects outwardly over the side of the base and rearwardly towards the handle. FIG. 7 shows a similar guard 39 for the other version thereof.

Therefore, in view of the foregoing, it can be seen that the novel knife sharpener of the present invention provides a new means for sharpening not only serrated blades or edges but straight blades or edges as well. These blades may take the form of a knife blade or the form of a scissors blade. Some serrated edge knives have serrations with spaces much smaller than it is possible to shape a porcelain sharpening element and still retain strength. The diameter of the corner 27 and 28 is approximately 1/32 of an inch. This diameter permits sharpening on serrated edges with much smaller diameters than is otherwise obtainable from the larger diameter cylindrical rod used in the prior art. The flat sides or surfaces 25 and 26 provide a greater surface contact for straight blades, chisels, arrowheads, or the like. By employing the fish hook slot 33 on one flat surface, sharpening of fish hooks is permitted and the additional hole or opening 18 at a proper angle permits sharpening of most scissor blades. The holes are shaped as a six pointed star to permit positioning of the porcelain abrasive element for flat or corner exposure as desired. The angle of cut is burr free and the edge being cut during the cutting of sharpening procedure is constantly engaging with different portions of the abrasive surface.

The corners of the triangles such as corners 27 and 25 have a tremendous "bite" when sharpening because of the narrow point-to-point contact. The corners will remove more blade steel before "loading up" as compared to the rod, and the corners will even "throw off" the built up steel deposit, which eliminates rotation of the sharpening element as required when using the rod.

Both the corners of the triangle as well as the rod surface tend to "roll the edge" of a very sharp blade due to the large PSI pressure on the point-to-point contact. By rotating to the flat surface, the greater spread of surface area of contact eliminates rolling to the edge and an even sharper edge is attainable. Because of the large spread of PSI pressure when using the flats, the flats will load up more easily than the corners because there is not sufficient pressure on contact to cut the steel through the thicker layers of deposited steel. The narrow corners are used first until and edge is reached followed by finishing on the flats.

The corners work excellently on any serrated knife, even the fine serrations of a steak knife or a frozen food knife. The triangle itself, as a file, will sharpen the edge of router bits, countersinks, etc. as well points like hooks or awls.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

I claim:

1. A blade sharpener comprising the combination of:

a base;

a pair of relatively wide and flat but elongated sharpening elements mounted in said base to extend upwardly from said base in acute angular relationship to said base;

said wide and flat sharpening elements lying in substantially the same plane, and the acute angle between each rod and said base being the same as that of the other one of said elements and said base;

each of said elements leaning in an opposite direction from said base, wherein said elements are mounted in said base in spaced diverging relation to each other and wherein upper portions of said elements terminated in spaced apart relationship;

each of said sharpening elements includes at least two broad, flat surfaces extending along opposite sides thereof;

said element includes a grooved slot of V-shaped cross section provided in a selected one of said broad, flat surfaces mid-way between the opposite sides of said selected element;

each of said elements includes a triangular cross section and said base includes a pair of openings diverging outwardly with respect to each other for insertably receiving each of said elements respectively; and wherein;

each of said openings is configured to correspond to said triangular cross of each of said elements, and each of said openings is configured to present a six-sided star so that each of said elements may assume a position of opposing flat surfaces or opposing corner edges.

2. The invention as defined in claim 1 wherein:

said base includes a hole provided in a selected end thereof for insertably receiving a third sharpening element;

each of said elements of said pair disposed at an angle of 22½ degrees from a vertical central line and said third sharpening element disposed at a 12½ degrees from a horizontal center line.

3. The invention as defined in claim 2 wherein:

said base includes a handle portion intended to be grasped by the hand of the user.

4. The invention as defined in claim 3 wherein:

said base includes a guard outwardly projecting from said top of said base adjacent one of said elements of said pair for protecting the hand of the user.

5. The invention as defined in claim 4 wherein:

said corners joining adjacent flat surfaces of each of said sharpening elements are rounded.

6. The invention as defined in claim 5 wherein:

said sharpening elements are composed of a porous ceramic material.

* * * * *